US009086009B2

(12) United States Patent
Mikame et al.

(10) Patent No.: US 9,086,009 B2
(45) Date of Patent: Jul. 21, 2015

(54) OUTBOARD ENGINE UNIT

(75) Inventors: Mamoru Mikame, Wako (JP); Yuichiro Tajima, Wako (JP); Masakatsu Miyao, Wako (JP); Tatsuya Kuroda, Wako (JP); Koji Kuriyagawa, Wako (JP)

(73) Assignee: HONDA MOTOR CO., LTD, Tokyo (JP)

( * ) Notice: Subject to any disclaimer, the term of this patent is extended or adjusted under 35 U.S.C. 154(b) by 522 days.

(21) Appl. No.: 13/082,028

(22) Filed: Apr. 7, 2011

(65) Prior Publication Data

US 2011/0253076 A1 Oct. 20, 2011

(30) Foreign Application Priority Data

Apr. 20, 2010 (JP) ..... 2010-097150

(51) Int. Cl.
*F01P 1/06* (2006.01)
*F01P 3/20* (2006.01)

(52) U.S. Cl.
CPC ..... *F01P 3/202* (2013.01); *F01P 2050/12* (2013.01); *F01P 2060/12* (2013.01)

(58) Field of Classification Search
USPC ..... 123/41.3, 41.31, 41.29, 41.01, 41.28, 123/41.42, 41.44, 41.45, 559.1, 563, 123/568.12; 60/605.3; 440/88 C, 88 D, 88 G, 440/88 J, 88 K, 88 M, 89 B, 89 C, 89 D
See application file for complete search history.

(56) References Cited

U.S. PATENT DOCUMENTS

| | | | | |
|---|---|---|---|---|
| 7,201,622 | B2 * | 4/2007 | Hoi | 440/52 |
| 7,607,958 | B1 * | 10/2009 | Hochmayr et al. | 440/75 |
| 2003/0017760 | A1 | 1/2003 | Gokan et al. | |
| 2004/0083730 | A1 * | 5/2004 | Wizgall et al. | 60/614 |
| 2007/0266965 | A1 * | 11/2007 | Hoi et al. | 123/41.45 |
| 2009/0130928 | A1 * | 5/2009 | Taylor et al. | 440/88 M |

FOREIGN PATENT DOCUMENTS

| | | | |
|---|---|---|---|
| JP | 60-222526 | A | 11/1985 |
| JP | 3-242419 | A | 10/1991 |
| JP | 5-141260 | A | 6/1993 |
| JP | 2006-528297 | A | 12/2006 |
| JP | 2007-132313 | A | 5/2007 |

OTHER PUBLICATIONS

Canadian Office Action dated Nov. 20, 2012, issued in corresponding Canadian Patent Application No. 2,736,333.
Japanese Office Action dated Oct. 29, 2013, issued in Japanese Patent Application No. 2010-097150, w/partial English translation.

* cited by examiner

*Primary Examiner* — Hung Q Nguyen
*Assistant Examiner* — Ruben Picon-Feliciano
(74) *Attorney, Agent, or Firm* — Westerman, Hattori, Daniels & Adrian, LLP

(57) ABSTRACT

A cooling device of an outboard engine unit includes a cooling water passage for delivering cooling water from a water pump. The cooling water passage branches into a first passageway for cooling a cylinder block and cylinder head of an engine and a second passageway for cooling a case of a supercharger. Thus, the supercharger and the engine can be cooled to and kept at their respective appropriate temperatures.

2 Claims, 6 Drawing Sheets

OUTBOARD ENGINE UNIT

FIELD OF THE INVENTION

The present invention relates to outboard engine units which include a cooling water passage for delivering cooling water from a water pump, and a supercharger for force-feeding air into an engine.

BACKGROUND OF THE INVENTION

Outboard end units have been known which are provided with a supercharger for boosting engine power output, and one example of such outboard end units is disclosed in Japanese Patent Application Laid-Open Publication No. HEI-05-141260 (hereinafter referred to as "the relevant patent literature").

As shown in FIG. 6 hereof, an engine of the outboard end unit disclosed in the relevant patent literature includes a crankcase 101, a cylinder body 102, a cylinder head 103, a crankshaft 104, a connecting rod (con rod) 105 and a piston 106. Fuel is combusted in a combustion chamber 107, and resultant exhaust of high temperature is discharged through an exhaust port 108. The engine further includes a supercharger 109 that force-feeds air into the combustion chamber 107 via a connecting pipe 110. Because the supercharger 109 gets hot during the force-feeding of air, it has to be cooled.

Cooling water is introduced via a water jacket 111, delivered through another water jacket 112 to still another water jacket 113, provided in the supercharger 109, to cool the supercharger 109, and then delivered through still other water jackets 114 and 115 to a further water jacket 116 to cool the cylinder body 102 and cylinder head 103, after which the cooling water is discharged.

Note that the engine cylinder block 102 and cylinder head 103 (i.e., engine-side components) and the supercharger 109 differ from each other in required cooling temperature range. However, in the outboard engine unit disclosed in the relevant patent literature, the supercharger 109 and the engine-side components are cooled by one and the same cooling system, and thus, it is difficult to appropriately adjust the temperatures of the supercharger 109 and the engine-side components independently of each other. Further, because the supercharger 109 that gets hot is provided within an engine cover, separate cooling and heat shielding structures are required for the supercharger 109, which would unavoidably lead to an increased size of the outboard engine unit.

SUMMARY OF THE INVENTION

In view of the foregoing prior art problems, it is an object of the present invention to provide an improved outboard engine unit which can cool the supercharger and the engine to their respective appropriate temperatures and yet can be reduced in size.

In order to accomplish the above-mentioned object, the present invention provides an improved outboard engine unit, which comprises a cooling device for water-cooling an engine equipped with a supercharger, the cooling device including a cooling water passage for delivering cooling water from a water pump, the cooling water passage branching into a first passageway for cooling a cylinder block and cylinder head of the engine and a second passageway for cooling a case of the supercharger.

Namely, in the cooling device of the outboard engine unit, the cooling passage branches into the engine-side, first passage way required to cool the engine at low temperature and the supercharger-side, second passageway for cooling the supercharger in such a manner as to keep it at relatively high low temperature, and thus, the supercharger and the engine (and various components around the supercharger and engine) can be cooled to their respective appropriate temperature. Particularly, the supercharger can be cooled to appropriate temperature.

In a preferred implementation, the first passageway branches into a first branch passageway extending from a water outlet of an intercooler, provided for the supercharger, to a water cooling jacket of the cylinder block and a second branch passageway extending to a water cooling jacket of the cylinder head. By such branching of the first passageway, the cylinder block and the cylinder head can be cooled to their respective appropriate temperature.

In a preferred implementation, the supercharger includes a water cooling jacket provided in the case, and the second passageway extends from a water outlet of an EGR cooler to connect to the water cooling jacket of the supercharger via a water cooling jacket of an exhaust manifold of the engine. As well known, cooling the supercharger to too low temperature is not preferable because the intake-air temperature of the engine would become too low, and thus, it is necessary to cool the supercharger to relatively high, low temperature. For this reason, the water cooling jacket of the supercharger in the present invention is disposed downstream of the water outlet of the EGR (Exhaust Gas Recirculation) cooler and water cooling jacket of the exhaust manifold. In this manner, the supercharger cooling water would rise to a certain degree, so that the supercharger can be cooled to and kept at its appropriate cooling temperature.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

Certain preferred embodiments of the present invention will hereinafter be described in detail, by way of example only, with reference to the accompanying drawings, in which.

DETAILED DESCRIPTION OF THE PREFERRED EMBODIMENTS

Figure 1:
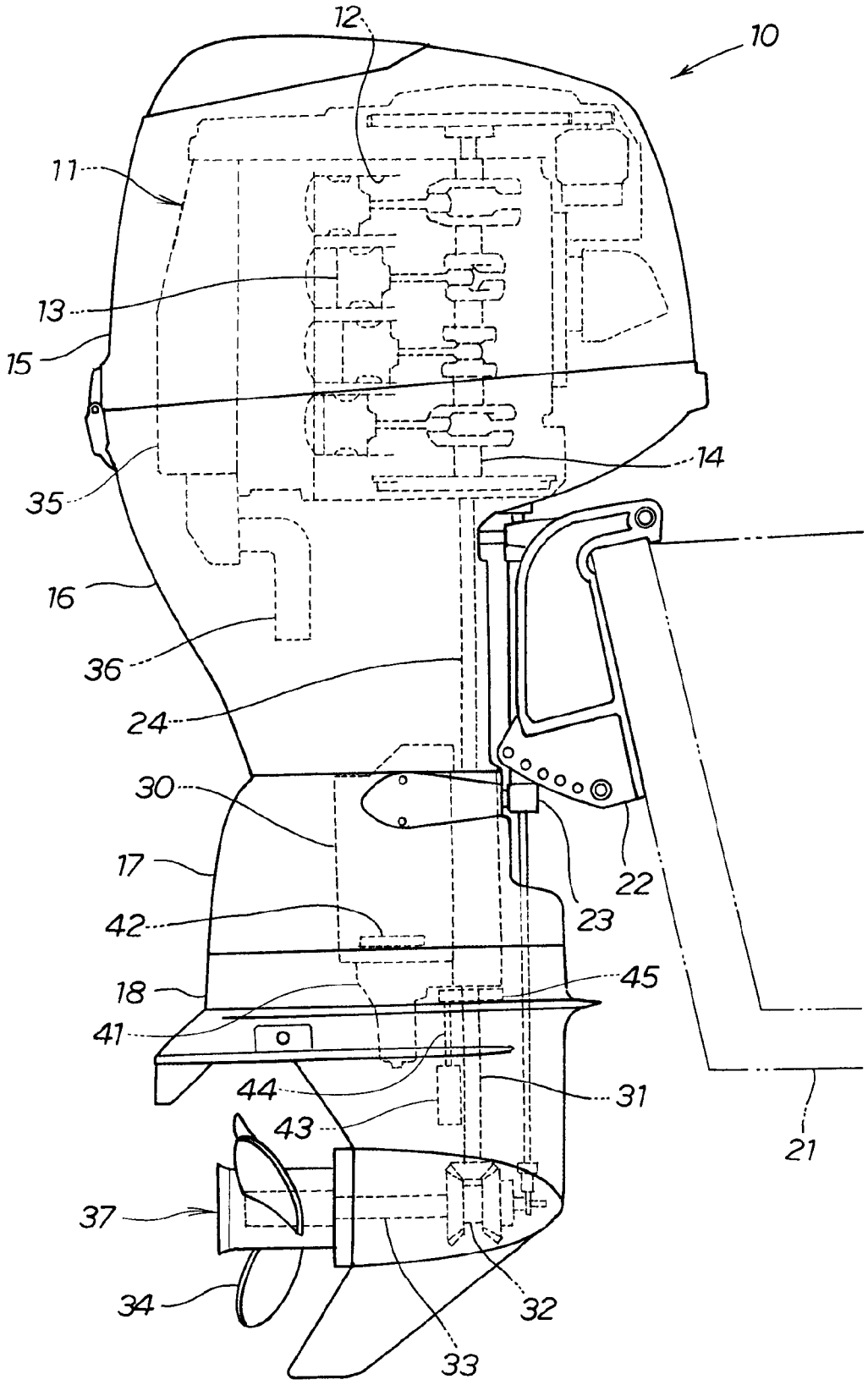
FIG. 1 is a side view showing an outboard engine unite according to a first embodiment of the present invention.

Reference is now made to FIG. 1 showing in side elevation an outboard engine unit 10 according to the first embodiment of the present invention, which includes an engine 11 provided in an upper region thereof. The engine 11 is a vertically-orientated engine where a cylinder 12 and piston 13 are oriented transversely while a crankshaft 14 and cam shaft are oriented vertically.

An outer covering of the outboard engine unit 10 includes an upper engine cover 15 that covers an upper portion of the engine 11, a lower engine cover 16 disposed under the upper cover 15, an extension case 17 disposed under the lower engine cover 16, and a gear case 18 disposed under the extension case 17.

The outboard engine unit 10 is mounted via a swivel shaft 23 to a stern bracket 22 fixed to a watercraft body 21, so that it is pivotable to a predetermined maximum steering angle relative to the stern bracket 22 about the swivel shaft 23.

Driving force of the engine 11 is transmitted to a drive shaft 31 via an output shaft 24 connected to the crankshaft 14, from which it is transmitted to a propeller 34 via a pair of dog clutches 32 and a propeller shaft 33. By switching between the dog clutches 32, the propeller 34 can be switched between forward rotation and reverse rotation, so that forward or rearward propulsion force can be provided. The propeller 34 is rotatably provided on the gear case 18.

Exhaust from the engine 11 passes through an engine-side exhaust pipe 36, connected to an exhaust manifold 35, into the lower cover 16, from which it passes through the extension case 17 and gear case 18 and then is discharged via a cylinder-shaped exhaust port 37 provided centrally through the propeller 34.

Further, a cooling water screen 43, cooling water supply pipe 44 and water pump 45 are accommodated in the extension case 17 and gear case 18, and cooling water pumped up by the water pump 45 is supplied to a later-described cooling water passage 51.

Figure 2:
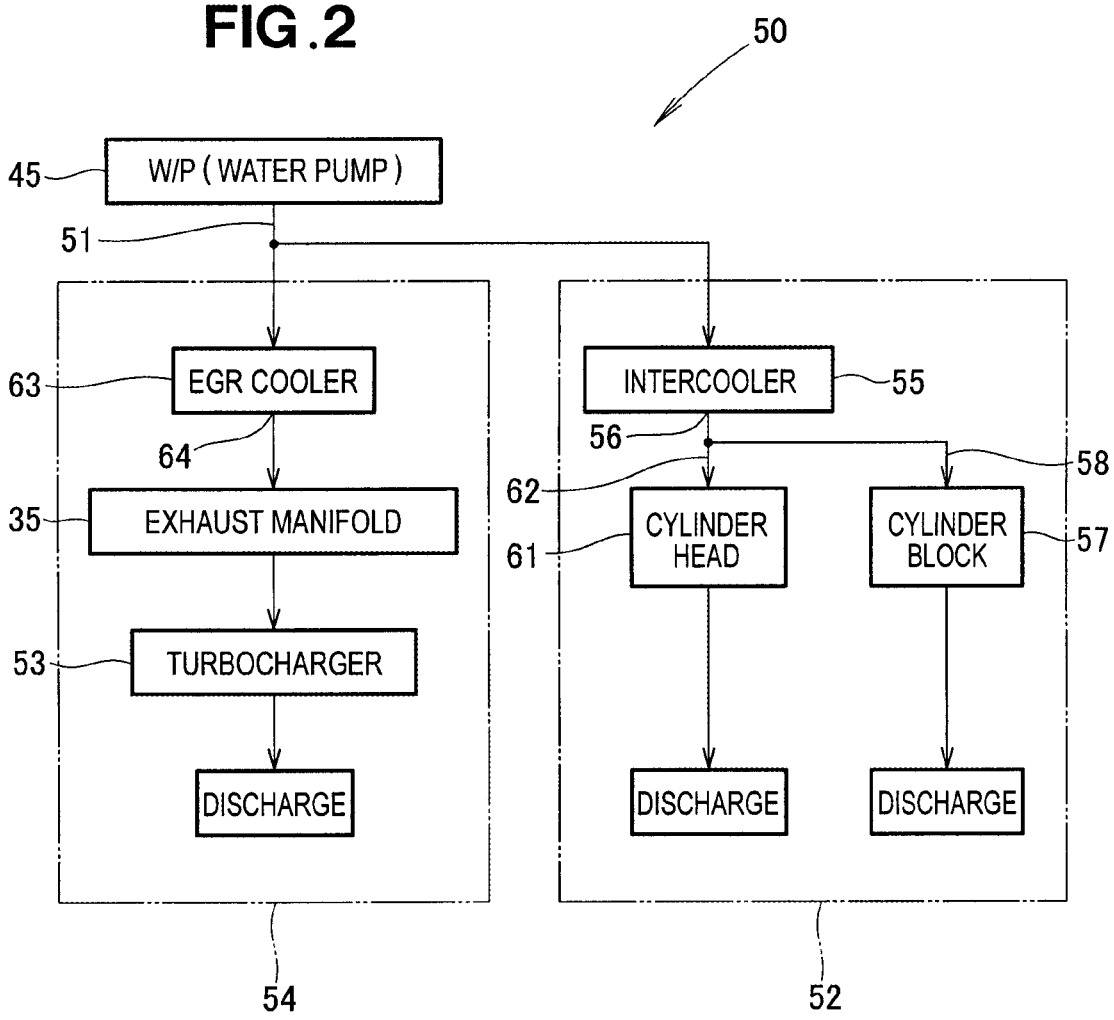
FIG. 2 is a block diagram illustrating cooling water flows in a cooling device in the outboard engine unit of FIG. 1.

The following describe cooling water flows in a cooling device 50. In the cooling device 50, as shown in FIG. 2, the cooling passage 51 for delivering the cooling water from the water pump 45 branches into a first passageway 52 for cooling engine-side components, i.e. cylinder block 57 and cylinder head 61 of the engine 11, (see FIG. 1) and a second passageway 54 for cooling a supercharger-side component, i.e. case 68 of a supercharger 53. Let it be assume here that the supercharger 53 employed in the first embodiment is a turbocharger.

Further, the first passageway 52 branches into a first branch passageway 58 extending from a water outlet 56 of an intercooler 55 to the cylinder block 57, and a second branch passageway 62 extending to the cylinder head 61. The cooling water of the first branch passageway 58 is discharged to the outside after cooling the cylinder block 57, and the cooling water of the second branch passageway 62 is discharged to the outside after cooling the cylinder head 61. Further, the cooling water of the second passageway 54 gets out of a water outlet 64 of an EGR (Exhaust Gas Recirculation) cooler 63 and then is discharged after sequentially cooling the exhaust manifold 35 and turbocharger 53.

Figure 3:
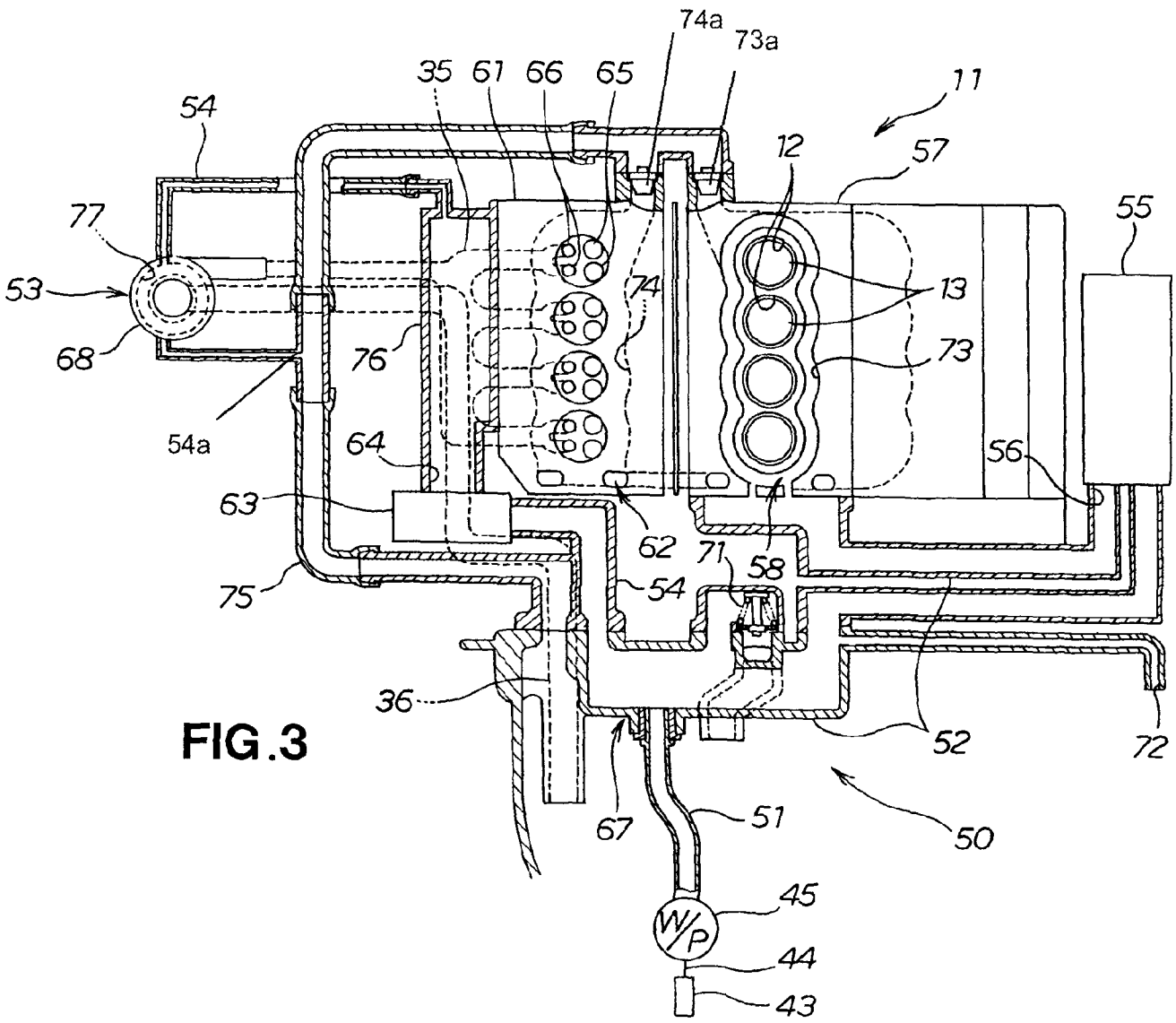
FIG. 3 is a sectional view showing details of the cooling device.

Next, a description will be given about details of the cooling device 50, with primary reference to FIG. 3. The cylinder block 57 includes the cylinder 12 slidably accommodating therein the piston 13. The cylinder head 61 includes an intake valve 65 and an exhaust valve 66. The exhaust manifold 35 is connected to the exhaust valve 66, the turbocharger 53 is connected to the exhaust manifold 35, and the engine-side exhaust pipe 36 is connected to the turbocharger 53. The engine-side exhaust pipe 36 branches halfway up to be connected to the EGR cooler 63, so that part of the exhaust is circulated in intake air.

Further, in the cooling device 50, the cooling passage 51 for delivering the cooling water from the water pump 45 branches, in a branch section 67, into the first passageway 52 for cooling the cylinder block 57 and cylinder head 61 of the engine 11 and the second passageway 54 for cooling the case 68 of the turbocharger 53.

A relief valve 71 and cooling-water pilot hole 72 are provided in the first passageway 52. The intercooler 55 is provided in a halfway region of the first passageway 52, and the first passageway 52 branches into the first branch passageway 58 extending from the water outlet 56 of the intercooler 55 to a water cooling jacket 73 of the cylinder block 57, and the second branch passageway 62 extending to a water cooling jacket 74 of the cylinder head 61.

The cooling water of the first branch passageway 58 cools the cylinder block 57 and then is discharged to the outside via a water discharge pipe 75, and the cooling water of the second branch passageway 62 cools the cylinder head 61 and then is discharged to the outside via the water discharge pipe 75.

The cooling water of the second passageway 54 gets out of the water outlet 64 of the EGR (Exhaust Gas Recirculation) cooler 63, sequentially passes through a water cooling jacket 76 of the exhaust manifold 35 and water cooling jacket 77 of the turbo charger 53 and then is discharged to the outside via the water discharging pipe 75. The second passageway 54 includes water outlet 54*a*. The cylinder block cooling water jacket 73 includes water outlet 73*a*. The cylinder head cooling water jacket 74 includes water outlet 74*a*.

Figure 4B:
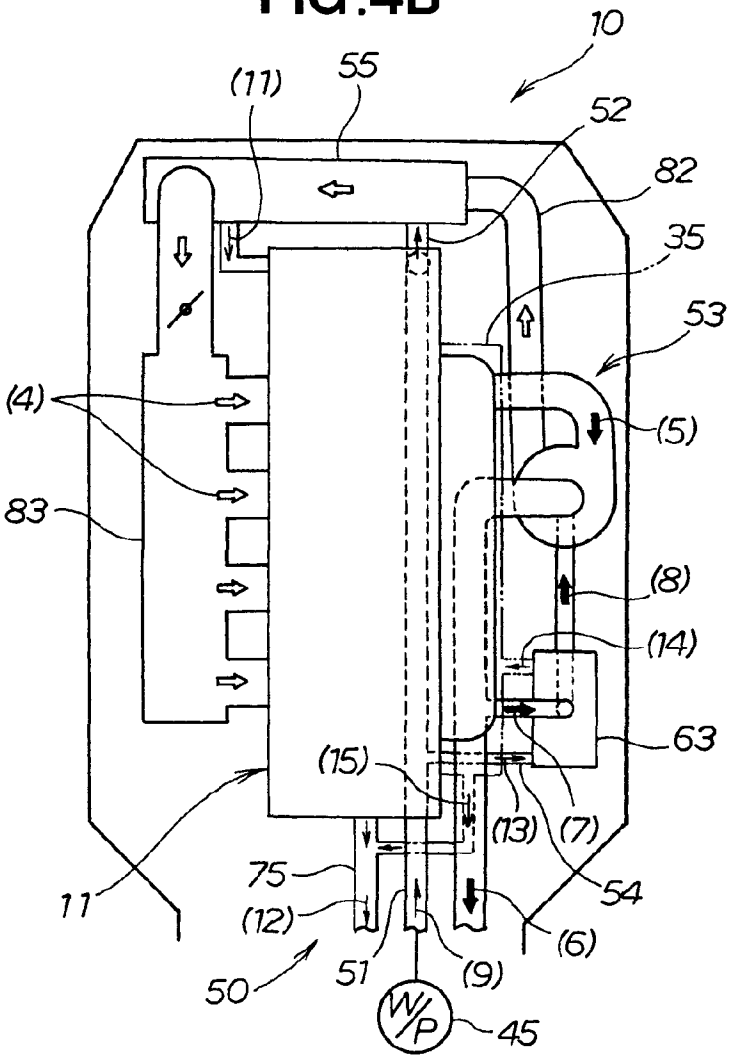
FIG. 4B is a view taken in the direction of arrow b of FIG. 4A.
Figure 4A:
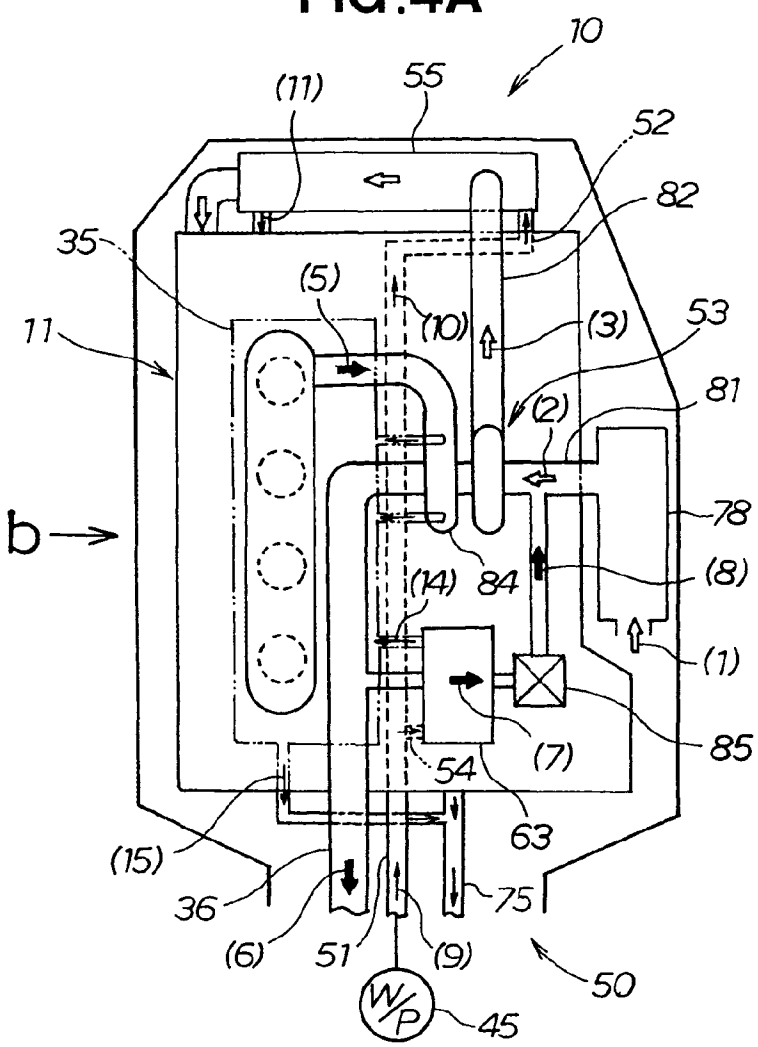
FIG. 4A is a schematic right side view of principal sections of the outboard engine unit.

Next, a description will be given about behavior of the above-described cooling device 50. FIG. 4A is a schematic right side view of principal sections of the outboard engine unit 10, and FIG. 4B is a view taken in a direction of arrow b of FIG. 4A.

Because the intercooler 55 is provided over the engine 11 as shown in FIG. 4A, a dimension, in a front-rear direction, of the outboard engine unit 10 can be significantly reduced.

Intake air is first input to a silencer 78 as indicated by arrow (1) and then delivered via a first intake air passageway 81 to the turbocharger 53 as indicated by arrow (2). The intake air compressed by the turbocharger 53 is delivered via a second intake passageway 82 to the intercooler 55 as indicated by arrow (3). Then, the intake air is delivered from the turbocharger 55 to the engine 11 via an intake manifold 83 as indicated by arrow (4) in FIG. 4B.

Exhaust air is delivered via the exhaust manifold 35 to a turbine section 84 of the turbocharger 53 as indicated by arrow (5) and then discharged via the engine-side exhaust pipe 36 as indicated by arrow (6). Also, part of the exhaust air passes through the EGR cooler 63 as indicated by arrow (7) and then joins the intake air of the first intake air passageway 81 via an EGR valve 85 as indicated by arrow (8).

Cooling water from the water pump 45 flows in the cooling passage 51 as indicated by arrow (9) and then is delivered via the first passageway 52 to the intercooler 55 as indicated by arrow (10). Then, the cooling water is delivered to the engine 11 as indicated by arrow (11) in FIG. 4B, from which it branches into two streams, one flowing through the first branch passageway 58 to cool the cylinder block 57 (see FIG. 3) and one flowing through the second branch passageway 62 to cool the cylinder head 61 (see FIG. 3) and then is discharged to the outside via the water discharging pipe 75 as indicated by arrow (12).

Meantime, part of the cooling water of the cooling passage 51 flows via the second passageway 54 into the EGR cooler 63 as indicated by arrow (13), from which the cooling water is delivered to the exhaust manifold 35 as indicated by arrow (14). Further, the cooling water is delivered from the exhaust manifold 35 to the turbo charger 53 and then discharged via the water discharging pipe 75 as indicated by arrow (15).

Next, description will be given as to a second embodiment of the outboard engine unit 10 with reference to FIGS. 5A and 5B, wherein similar elements to those of the first embodiment are indicated by the same reference numerals as used for the first embodiment and will not be described here to avoid unnecessary duplication.

Figure 5B:
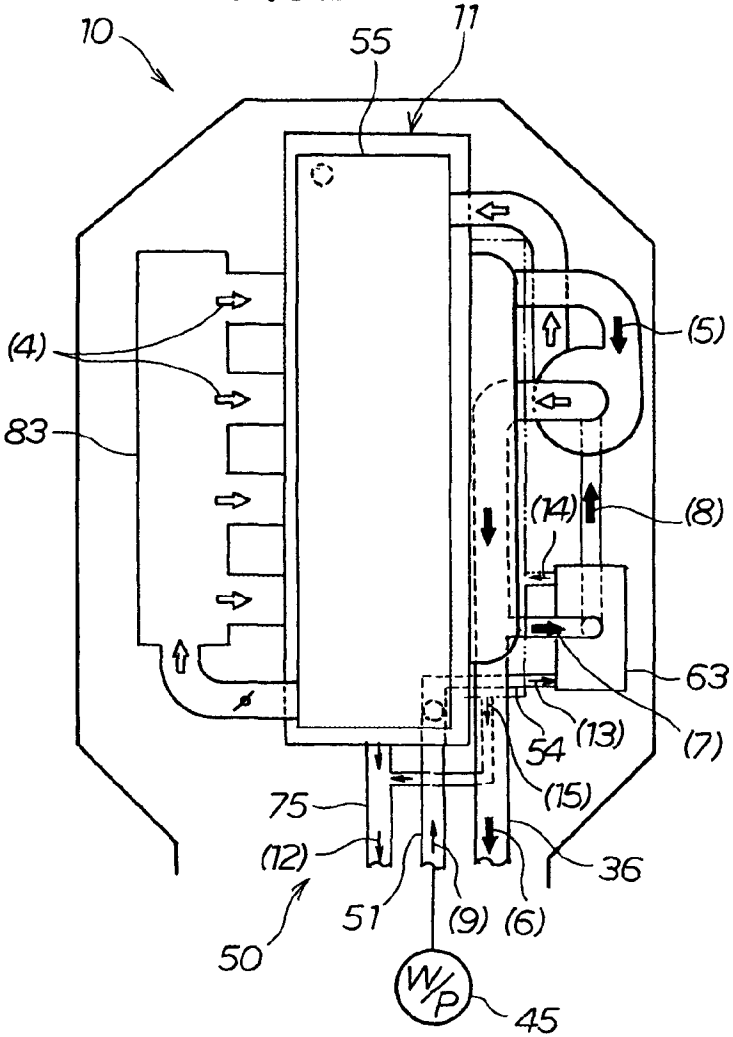
FIG. 5B is a view taken in the direction of arrow b of FIG. 5A.
Figure 5A:
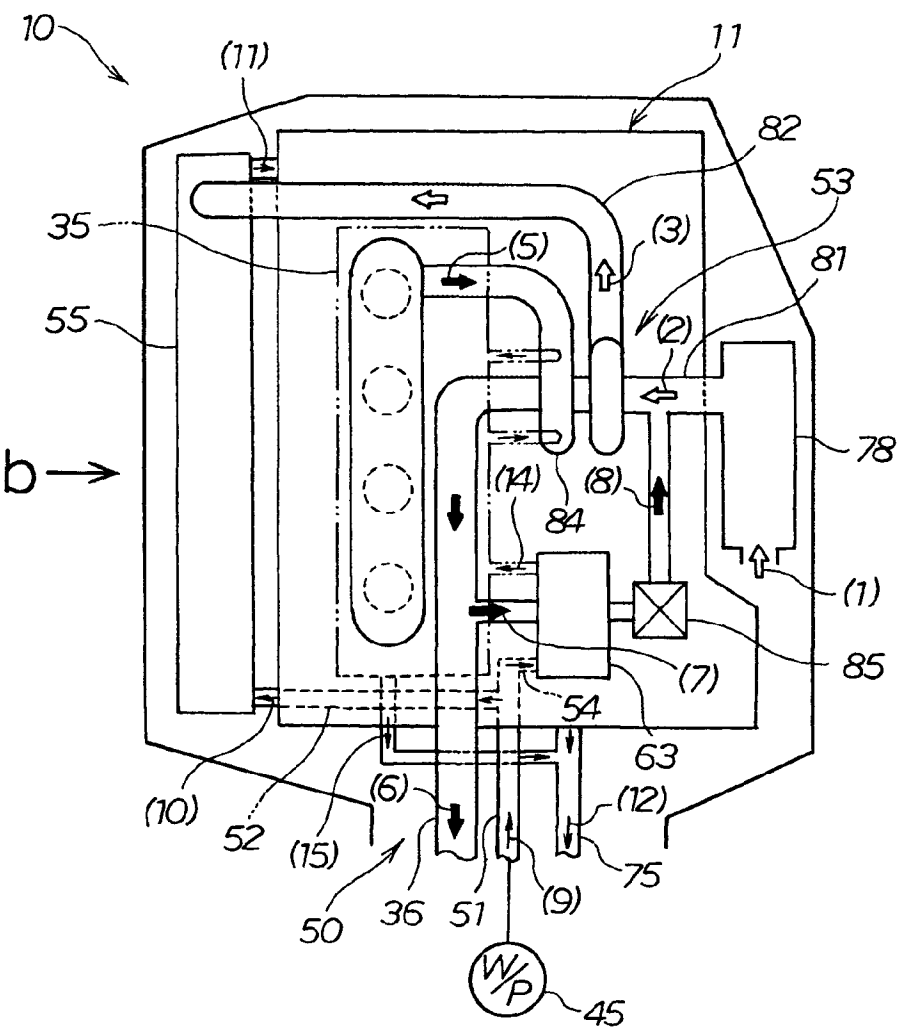
FIG. 5A is a schematic right side view showing principal sections of an outboard engine unit according to a second embodiment of the present invention.
Figure 6:
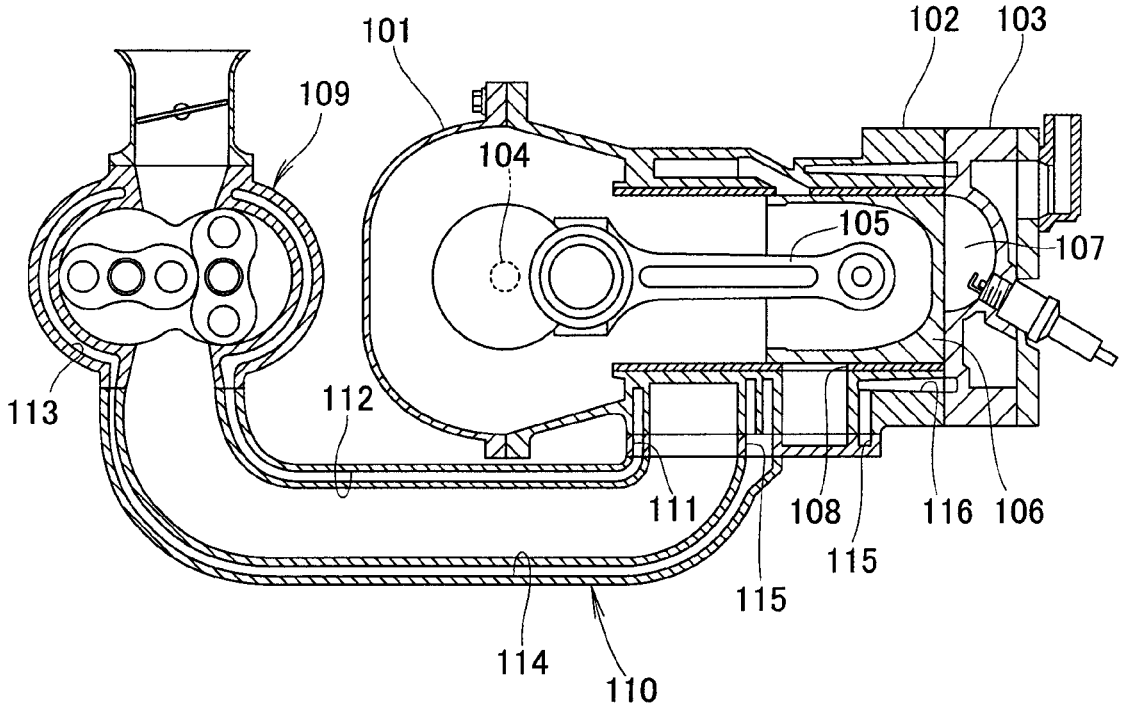
FIG.6 (PRIOR ART)
FIG. 6 is a sectional view illustrating a cooling water passage in a conventionally-known outboard engine unit.

FIG. 5A is a schematic right side view of principal sections of the second embodiment of the outboard engine unit 10, and FIG. 5B is a view taken in a direction of arrow b of FIG. 5A.

Because the intercooler 55 is provided behind or rearwardly of the engine 11 as shown in FIG. 5A, a dimension, in an up-down direction, the outboard engine unit 10 can be significantly reduced. Behavior of the cooling device 50 in the second embodiment of the outboard engine unit 10 is generally the same as the behavior of the cooling device 50 of the first embodiment described above in relation to FIG. 4.

The following summarize the outboard engine unit 10 of the present invention. As shown in FIG. 3, in the outboard engine unit 10 of the present invention including the cooling device 50 for cooling the engine 11 equipped with the turbocharger 53, the cooling passage 51 for delivering the cooling water from the water pump 45 branches into the first passageway 52 for cooling the cylinder block 57 and cylinder head 61 of the engine 11 and the second passageway 54 for cooling the case 68 of the turbocharger 53.

Namely, the cooling passage 51 branches into the turbocharger-side, second passageway 54 for cooling the turbocharger 53 in such a manner as to keep it at relatively high low appropriate temperature and the engine-side, first passage way 52 for cooling the engine 11 to keep it at low temperature, and thus, the turbocharger 53 and the engine 11 can be cooled to and kept at their respective appropriate temperatures. Further, because the turbocharger 53 that can be cooled to and kept at appropriate temperature can be mounted for the engine 11 of the outboard engine unit 10 without any problem, no extra heat shielding structure etc. are required, so that the high-power engine 11 and hence the outboard engine unit 10 can be reduced in overall size.

As described above in relation to FIG. 3, the first passageway 52 branches into the first branch passageway 58 extending from the water outlet 56 of the intercooler 55, provided for the turbocharger 53, to the cylinder block 57, and the second branch passageway 62 extending to the cylinder head 61. By such branching of the first passageway 52, the cylinder block 57 and the cylinder head 61 can be cooled to and kept at their respective appropriate temperatures.

As further described above in relation to FIG. 3, the turbocharger 53 includes the water cooling jacket 77 accommodated in the case 68, and the second passageway 54 extends from the water outlet 64 of the EGR cooler 63 to connect to the water cooling jacket 77 of the turbocharger 53 via the water cooling jacket 76 of the exhaust manifold 35. Namely, the water cooling jacket 77 of the turbocharger 53 is disposed downstream of the water outlet 64 of the EGR cooler 63 and water cooling jacket 76 of the exhaust manifold 35. In this manner, the turbocharger cooling water would rise to a certain degree, so that the turbocharger 53 can be cooled to and kept at its appropriate cooling temperature.

It should be appreciated that the intercooler 55, EGR cooler, etc. may be disposed at other suitable positions than the aforementioned relative to the body of the engine 11, and that the cooling passage 51 may be arranged in any other suitable manner than the aforementioned as long as it branches into the first passageway 52 for cooling the body of the engine 11 and the second passageway 54 for cooling the case 68 of the turbocharger 53. Further, the supercharger 53 employed in the outboard engine unit 10 of the present invention is not limited to a turbocharger and may be any other suitable type as long as it can raise the pressure of fresh air (new charged air) for enhancing the intake efficiency higher than the ambient atmospheric pressure.

The basic principles of the present invention are well suited for application to outboard engine units including a cooling water passage for delivering cooling water from a water pump and a supercharger for force-feeding air to an engine.

What is claimed is:

1. An outboard engine unit comprising:

an engine having a cylinder block, a cylinder head, an intake manifold, and an exhaust manifold;

a supercharger equipped with the engine, the supercharger being in fluid communication with the exhaust manifold and the intake manifold of the engine such that the supercharger is drivable by exhaust gases from the engine to increase a volume of intake air to be introduced in the intake manifold of the engine;

an intercooler provided for the supercharger, the intercooler being communicated with and disposed between the supercharger and the intake manifold of the engine;

an EGR cooler provided for introducing a part of the exhaust gases from the exhaust manifold into intake air to be drawn into the intake manifold; and a cooling device configured to water-cool the engine and the supercharger separately, said cooling device comprising a cooling water passage configured to deliver cooling water from a water pump, the cooling water passage branching into a first passageway for cooling the cylinder block and cylinder head of the engine and a second passageway for cooling a case of the supercharger, wherein the intercooler is provided in the first passageway of the cooling water passage and disposed upstream of the cylinder block and the cylinder head of the engine as viewed from a direction of flow of the cooling water inside the first passageway, wherein the EGR cooler, the exhaust manifold, and the supercharger are provided in the second passageway of the cooling water passage in the named order as viewed from a direction of flow of the cooling water inside the second passageway, wherein the cooling device further comprises a cylinder block water cooling jacket provided for the cylinder block, and a cylinder head water cooling jacket provided for the cylinder head, wherein the intercooler has a water outlet, and the first passageway branches into a first branch passageway extending from the water outlet of the intercooler to the cylinder block water cooling jacket and a second branch passageway extending from the water outlet of the intercooler to the cylinder head water cooling jacket, and wherein the cooling device comprises a single water discharge pipe for discharging the cooling water to the outside of the cooling device, the single water discharge pipe being connected with water outlets of the cylinder block water cooling jacket and the cylinder head water cooling jacket and also with a water outlet of the second passageway such that a first part of the cooling water having cooled the cylinder block, a second part of the cooling water having cooled the cylinder head, and a third part of the cooling water having cooled the supercharger join together in the single water discharge pipe and are collectively discharged from the single water discharge pipe to the outside of the cooling device.

2. The outboard engine unit of claim 1, further comprising:

a supercharger water cooling jacket provided for the supercharger; and an engine exhaust manifold water cooling jacket provided for the exhaust manifold of the engine, wherein the EGR cooler has a water outlet, the supercharger water cooling jacket is provided inside the case of the supercharger, and the second passageway is configured to extend from the water outlet of the EGR cooler and to connect to the supercharger water cooling jacket via the engine exhaust manifold water cooling jacket.

* * * * *